US006877825B2

(12) United States Patent
Khosropour et al.

(10) Patent No.: US 6,877,825 B2
(45) Date of Patent: Apr. 12, 2005

(54) MODULAR KITCHEN SYSTEM

(75) Inventors: Mostafa Michael Khosropour, Newton, IA (US); Evelyn M. George, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/365,439

(22) Filed: Feb. 13, 2003

(65) Prior Publication Data

US 2003/0227240 A1 Dec. 11, 2003

Related U.S. Application Data

(60) Provisional application No. 60/386,452, filed on Jun. 7, 2002.

(51) Int. Cl.[7] ..... A47B 51/00; A47B 77/00

(52) U.S. Cl. ..... 312/198; 312/140.1; 312/319.7; 312/351.3

(58) Field of Search ..... 312/140.1, 198, 312/199, 200, 319.5, 319.7, 351.1, 351.3

(56) References Cited

U.S. PATENT DOCUMENTS

| | | | | | |
|---|---|---|---|---|---|
| 2,050,617 | A | * | 8/1936 | Litner | 312/228 |
| 2,544,822 | A | * | 3/1951 | Brown | 312/351.3 |
| 2,594,516 | A | | 4/1952 | Swisher | |
| 3,472,219 | A | * | 10/1969 | Roy et al. | 126/37 R |
| 3,729,245 | A | | 4/1973 | Skifstrom | |
| 3,746,417 | A | | 7/1973 | Sasnett | |
| 3,892,452 | A | | 7/1975 | Williams et al. | |
| 3,926,486 | A | | 12/1975 | Sasnett | |
| 3,971,605 | A | | 7/1976 | Sasnett | |
| 4,009,918 | A | * | 3/1977 | MacDonald et al. | 312/351.3 |
| 4,616,887 | A | | 10/1986 | Oudman | |
| D296,850 | S | | 7/1988 | Pamio | |
| 4,894,600 | A | * | 1/1990 | Kearney | 318/649 |
| 5,088,421 | A | * | 2/1992 | Beckstead | 108/147 |
| 5,867,847 | A | * | 2/1999 | Klawitter et al. | 4/645 |
| 5,909,933 | A | | 6/1999 | Keene et al. | |
| 5,951,127 | A | | 9/1999 | Smith | |
| 6,213,575 | B1 | | 4/2001 | Brin, Jr. et al. | |

FOREIGN PATENT DOCUMENTS

| | | | |
|---|---|---|---|
| DE | 31 13602 | A1 | 10/1982 |
| EP | 0 401 465 | | 12/1990 |
| EP | 0 402 283 | | 12/1990 |
| EP | 0 661 015 | A1 | 7/1995 |
| FR | 0402283 | A1 * | 12/1990 |
| GB | 2 061 700 | | 5/1981 |
| JP | 405253022 | * | 10/1993 |
| NL | 0661015 | A1 * | 12/1994 |

* cited by examiner

*Primary Examiner*—Peter M. Cuomo
*Assistant Examiner*—Joseph Edell
(74) *Attorney, Agent, or Firm*—Diederiks & Whitelaw, PLC

(57) ABSTRACT

A vertically adjustable modular kitchen system includes a modular appliance and/or storage unit including a first frame section, a base unit including a second frame section having arranged therein a plurality of vertically adjustable supports and a control. The modular appliance and/or storage and base units are designed to interconnect one with the other forming a kitchen system. The control, provided with each base unit, enables a consumer to adjust the vertical height of the kitchen assembly associated with the particular base unit by raising or lowering the vertically adjustable supports. The appliance and/or storage and base units are further designed to integrate into either wall assemblies or kitchen island assemblies. The modular appliance and/or storage units will include a variety of configurations such as storage modules and appliance modules. Appliance modules are each designed to accommodate a particular appliance enabling a consumer to design and construct a kitchen system to meet particular needs.

18 Claims, 6 Drawing Sheets

MODULAR KITCHEN SYSTEM

CROSS-REFERENCE TO RELATED APPLICATIONS

The present application claims the benefit of U.S. Provisional Patent Application Ser. No. 60/386,452 filed Jun. 7, 2002.

BACKGROUND OF THE INVENTION

1. Field of the Invention

The present invention pertains to the art of kitchen construction and, more particularly, a kitchen system including multiple base units which are use to interconnect multiple appliance and/or storage modules, with at least the appliance and/or storage modules being easily interchangeable in order to enable a kitchen system to readily conform to the particular needs or preferences of a consumer.

2. Discussion of the Prior Art

The kitchen has become the focal point or nerve center of most homes. As such, manufacturers are putting more time and effort into designing kitchen systems that will accommodate a wide range of consumer tastes, needs and spatial requirements. In addition to addressing generally universally perceived needs, it would be beneficial to enable current designs to adapt to the changing requirements of an individual consumer.

In the past, a master carpenter was typically utilized to design and build a custom kitchen. This required a great deal of time, effort and expense in order to bring any individual consumer's dream to fruition. Over time, kitchen designers developed various models which overcame the need for employing a skilled carpenter to construct a cabinet system. These models generally took the form of cabinets sections which could be interconnected, even by a homeowner, to create a custom kitchen system. More specifically, it is now possible to select from different, commercially available cabinet sections, have the selected sections delivered to a home, manually position the sections relative to one another in a given kitchen, and then interconnect the sections on site using basic carpentry skills. Often, computers are used to aid in designing the overall layout and in ordering the desired sections.

While a homeowner currently has available a rather wide variety of options, cabinet sections are still targeted to installation about the perimeter of the kitchen. In other words, custom designing of kitchen cabinetry are essentially limited to wall mounted units which, in combination with special spacer sections, can be fit about perimeter portions of a kitchen. This arrangement, while effective in enabling a consumer to design the wall cabinetry in a kitchen, does not lend itself to readily reconfiguring the established layout or the construction of kitchen islands.

Kitchen island assemblies, by design, are visible from all sides. Wall mounted cabinet sections are, by design, constructed having an unfinished rear portions adapted to engage a wall surface. As such, combining sections to create a kitchen island assembly requires more than basic carpentry skills. If a consumer desires a kitchen island, either a pre-configured island is needed or a skilled artisan is required to construct the frame, run any required electrical and gas connections and subsequently finish the structure.

In addition to meeting spatial requirements, kitchens are designed to accommodate consumers having an average height. This means that consumers, above or below the average height, are typically forced to work at a work surface in an uncomfortable or awkward position. One method to correct this problem was to enable a vertical height adjustment associated with the work surfaces, wherein a control mechanism can be actuated by the consumer in order to raise or lower the kitchen assembly to a desired height. Additionally, vertically height adjustable kitchen islands have also been developed to provide consumers the ability to varying work surface heights to comfortable positions.

Regardless of the existence of prior proposed systems, there lacks the ability to readily modify an established kitchen configuration. This is particularly true with respect to kitchen islands. There certainly exists a need for wall or island arrangements which can be both vertically adjustable and readily configurable, while not requiring a specially skilled artisan for initially assembling or subsequently reconfiguring the overall system. There also exists a need for a vertically adjustable kitchen assembly which can be readily reconfigured, preferably by a consumer, such as by interchanging one appliance module for another, while not having to alter the vertical adjustment system. Accordingly, there exists a need in the art for a reconfigurable, modular kitchen system which enables one possessing basic carpentry skill to construct and later, if desired, reconfigure a vertically adjustable kitchen system.

SUMMARY OF THE INVENTION

The present invention is directed to a modular, vertically adjustable kitchen system including interchangeable base units, appliance and/or storage modules which are capable of integrating into either a kitchen wall unit or a kitchen island unit. More particularly, the kitchen system includes first and second modular base units each defining a base frame and at least one vertical adjustment mechanism to effect vertical shifting of the first and second base units. At least one replaceable, appliance and/or storage module is also provided, each designed to include storage space or alternatively to receive a selected one of a variety of kitchen appliances, such as cooktops, ranges, dishwashers and the like, so as to define a modular appliance unit. Each appliance and/or storage module(s) is secured to and interposed between the base units. In addition, a kitchen countertop extends over the first and second base units, as well as the interposed, replaceable modular appliance and/or storage unit(s). A control unit is operatively coupled to the vertical adjustment mechanism, wherein selective activation of the control unit operates to vertically adjust a height of the overall modular kitchen system in unison. In this manner, the kitchen system is constructed in sections, with each section including separate base units, storage or appliance modules, and a work surface which can be customized to the preferences of the consumer, while enabling the interconnected modules to be simultaneously, vertically adjusted without affecting the height of adjacent sections.

The appliance and/or storage modules preferably further include flexible door assemblies and finishing sheathing panels. The sheathing panels are constructed and sized to interconnect with various modular units, thus serving as a finishing sheathing for the kitchen system. In a preferred form of the invention, the sheathing panels are easily interchangeable. In this manner a consumer can easily install the finishing to the sections and to take advantage of available customizing color/texture/design options or alternatively adapt the kitchen system to meet future needs.

Additional objects, features and advantages of the present invention will become more readily apparent from the following detailed description of a preferred embodiment, when taken in conjunction with the drawings wherein like reference numerals refer to corresponding parts in the several views.

DETAILED DESCRIPTION OF THE PREFERRED EMBODIMENTS

Figure 1:
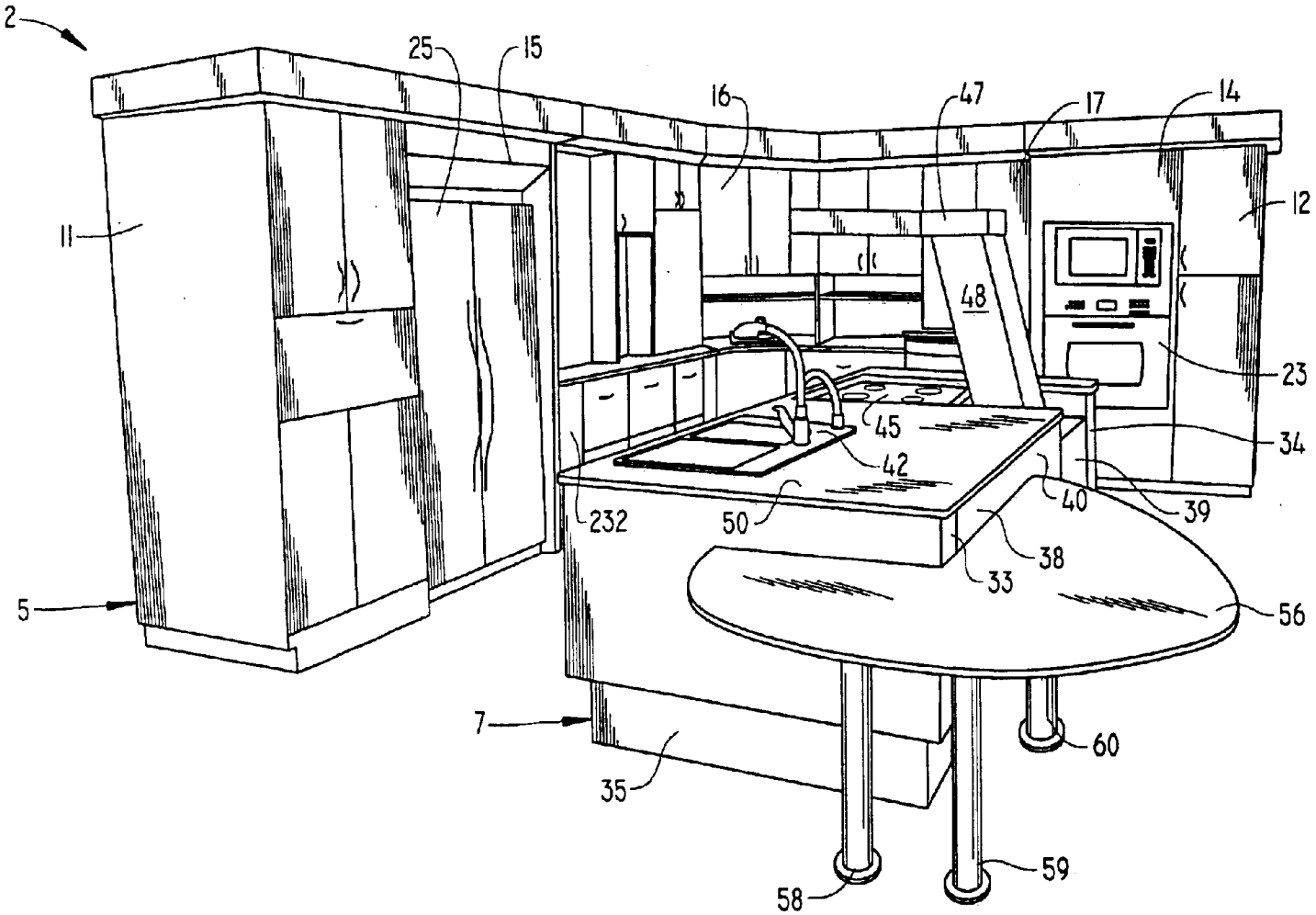
FIG. 1 is a perspective view of an overall modular kitchen system including both island and wall assemblies.

With initial reference to FIG. 1, an overall modular kitchen system constructed in accordance with the present invention is generally indicated at 2. As depicted, kitchen system 2 includes both a wall assembly 5 and an island assembly 7. Although details of wall assembly 5 will be provided more fully below with reference to FIG. 6, at this point it should at least be recognized that wall assembly 5 is constituted by a plurality of sections constructed from a select arrangement of fixed storage units 11, 12, fixed appliance units 14, 15, and modular appliance and/or storage units 16 and 17 constructed in accordance with the present invention. In the embodiment shown, fixed appliance unit 14 takes the form of a wall oven 23, while fixed appliance unit 15 includes a refrigerator 25. In general, fixed storage units 11 and 12, as well as fixed appliance units 14 and 15 merely complete the overall kitchen assembly. However, these units are not part of the essence of the invention such that no further discussion thereof will be made here. Instead, at this point, it is simply important to note the presence and extent of appliance units 14 and 15 which, as indicated above, will be detailed more fully below.

Particular attention will now be made to FIG. 2 in describing kitchen island 7 of kitchen system 2. In the embodiment shown, island assembly 7 includes a pair of laterally spaced and vertically adjustable modular base units 33 and 34. Modular base units 33 and 34 includes vertically adjustable support members 35 and 36 respectively, the details of which will be discussed more fully below. Interposed and interconnected to base units 33 and 34 are a plurality of modular appliance units 38 and 39, as well as a modular storage unit 40. At this point, it should be noted that modular appliance and storage units 38–40 are replaceable and interchangeable in accordance with the invention such that the overall modular kitchen island can be customized to a particularly dimensioned kitchen and the preferences of each consumer.

As shown, modular appliance unit 38 constitutes a sink module including an associated sink 42, modular appliance unit 39 constitutes a cooking module including a cooktop 45 and an adjustable cooktop vent hood 47 mounted on a vertically and horizontally support 48, and modular storage unit 40 defines cabinetry. As shown in this figure, kitchen island 7 also includes a countertop 50 secured atop base units 33, 34, appliance units 38, 39 and storage unit 40, thereby serving as a working surface. Countertop or work surface 50 is of a type generally known in the art, such as a laminate, CORIAN, granite or the like. An island tabletop 56 is arranged directly adjacent to, but preferably separate from, kitchen island 7. Although the structure and arrangement of tabletop 56 is not part of the basic modular construction of the present invention, tabletop 56 preferably includes a plurality of vertically adjustable support members 58–60 (see FIG. 1) such that tabletop 56 can be vertically adjusted relative to kitchen island 7.

In accordance with the present invention, arranged about and serving as a finish covering for wall and island assemblies 5 and 7 are a plurality of decorative sheathing panels generally indicated at 62. Sheathing panels 62 are sized in accordance with the particular design of modular kitchen assembly 2. Alternatively, each module can preferably include one or more associated sheathing panels 62 such that custom sizing is not required. In any event, sheathing panels 62 are provided as a finishing touch to the overall modular kitchen system 2, with the actual design, type and nature being left up to the particular preferences of the consumer.

Figure 2:
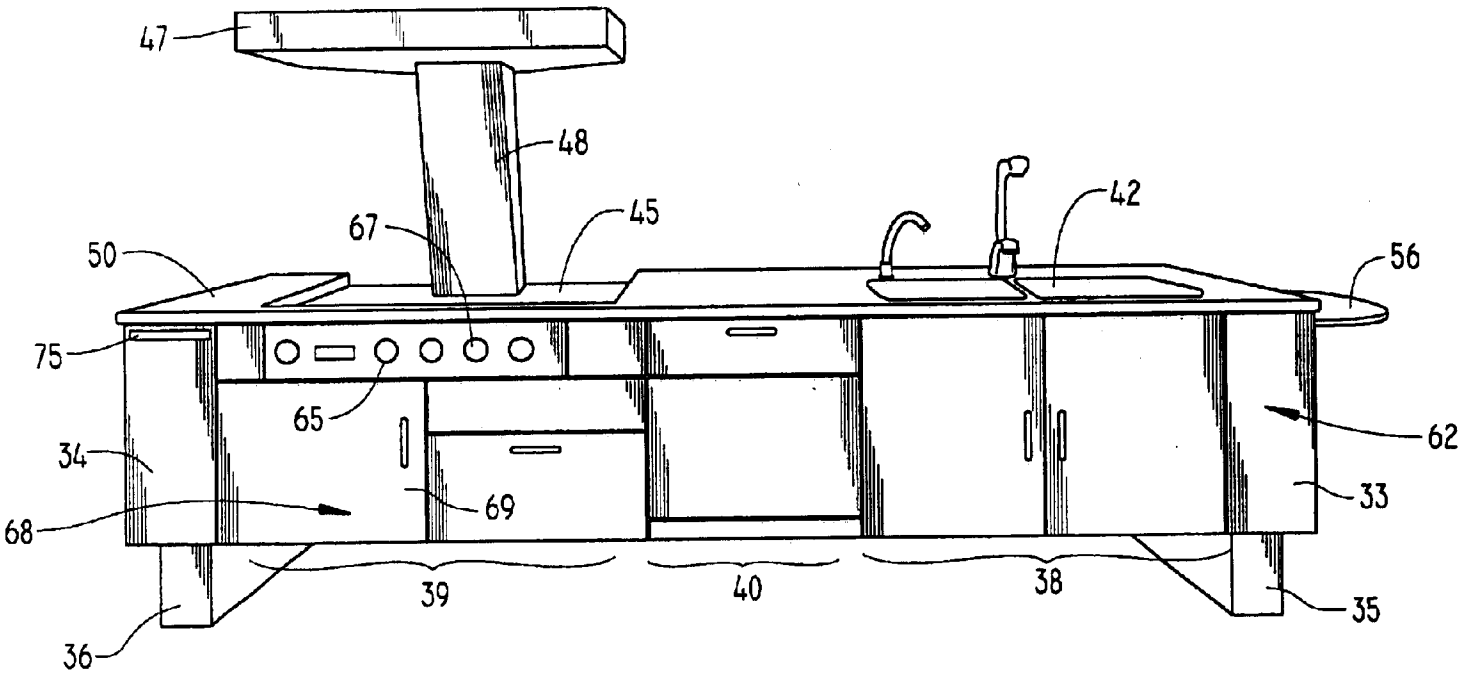
FIG. 2 is an enlarged perspective view of the kitchen island assembly of FIG. 1.

Referring further to FIG. 2, modular appliance unit 39 constructed in accordance with the present invention will be described with more detail. As set forth above, appliance unit 39 includes a cooktop 45 arranged within an upper portion of modular appliance unit 39. Arranged on a front surface of appliance unit 39 is a control panel 65 including a plurality of control members 67 provided to selectively activate heating elements (not shown) arranged about cooktop 45. In addition to carrying cooktop 45, appliance unit 39 includes a plurality of storage units, as generally indicated at 68, having associated therewith door assemblies 69. Storage units 68 are provided to establish storage space for pots, pans, griddles and the like.

In one form of the invention, a control drawer 75 having associated therewith a control unit 77 is arranged on an upper portion of base unit 34. The structure and operation of control unit 77 will be set forth more fully below with specific reference to FIG. 5. However, at this point, it should be noted that control drawer 75 is preferably constituted by a slide-out drawer similar to the type used for compact disc players. However, it should be understood that control unit 77 could be arranged on or recessed within an exposed surface of kitchen island 7.

Figure 3:
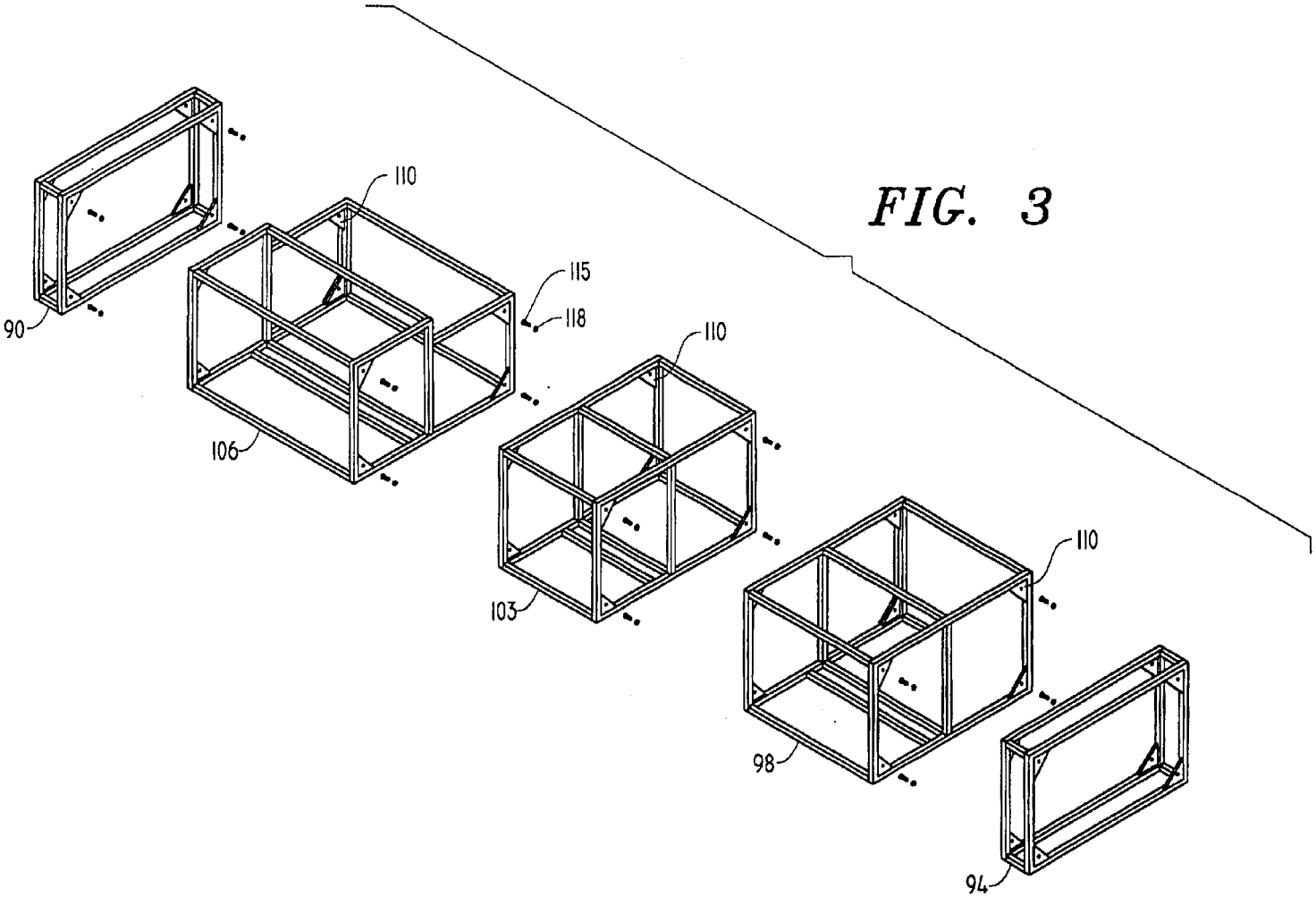
FIG. 3 is an exploded view of a plurality of modular units incorporated into the overall kitchen island of FIG. 2.

Referring to FIG. 3, the basic components of kitchen island 7 are depicted without sheathing panels 62. In accordance with the present invention, base units 33 and 34 are constructed from base frame sections 90 and 94 respectively. In a similar manner, appliance units 38 and 39 are constructed from frame sections 98 and 106 respectively, while storage unit 40 is incorporates a frame section 103. In one form of the invention, frame sections 90, 94, 98, 103 and 106 are constructed from building lumber. In more preferred forms of the invention, steel, aluminum or other metal building members are used. In any case, each of the modular frame sections 90, 94, 98, 103 and 106 is preferably formed with a plurality of gussets 110 which not only add support to the overall structural arrangement, but establish connection locations for interconnecting adjacent modular frame sections 90, 94, 98, 103 and 106. That is, in accordance with the present invention, modular kitchen assembly 2 is formed by interconnecting modular frame sections selected from various appliance and storage units, with each module being sized such that it can be readily joined to an associated adjacent module. As further shown in FIG. 3, modular frame sections 90, 94, 98, 103 and 106 are preferably joined at gussets 110 through a plurality of bolts 115 and nuts 118.

With this simple construction, modular kitchen island 7 can be readily assembled by one possessing basic carpentry or mechanical skills. At the same time, individual appliance and/or storage units can be readily interchanged or replaced as desired.

The present invention is not only particularly directed to the versatility in design of kitchen island 7 due to the readily interchangeable or replaceable appliance and storage units, but also the ability of an assembled kitchen island to be vertically adjusted such that work surface 50 of island 7 can be placed at varying levels based on the height or simple preference of the consumer. In accordance with the present invention, the vertical adjustability is established only at the base units 33 and 34. However, the entire kitchen island 7 is vertically adjustable due to the direct interconnection between the adjacent modular frame sections 90, 94, 98, 103 and 106. In addition, as indicated above, countertop 50 can be shifted relative to tabletop 56 in order to adjust the respective heights of the two work surfaces.

Figure 4:
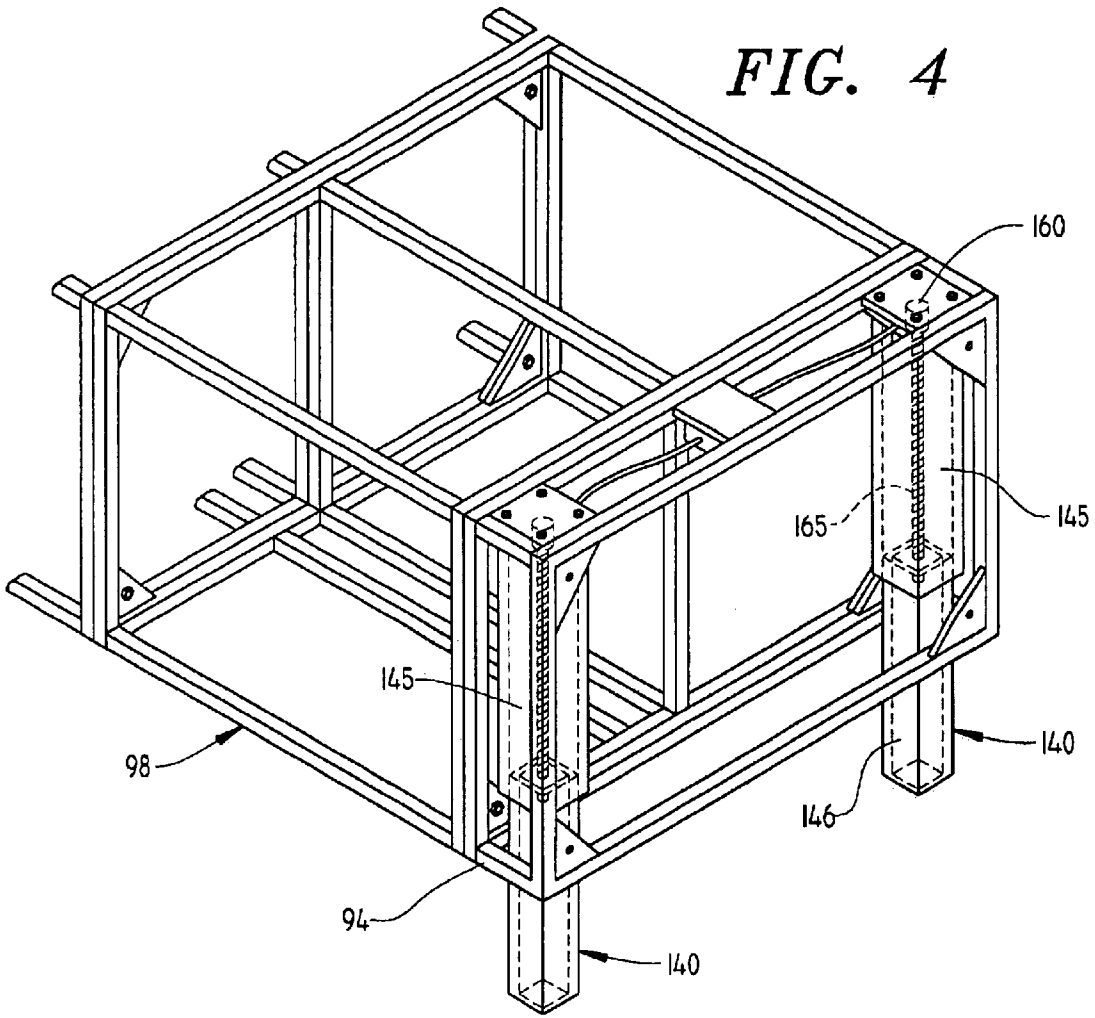
FIG. 4 is an enlarged, assembled internal view of the kitchen island of FIG. 3.

As shown in FIG. 4, a pair of lifting mechanisms 140, each including first and second relatively shiftable, telescopically arranged components 145,146, are positioned within each base frame section 90, 94. Lifting mechanisms 140 are provided to selectively adjust the vertical height of island assembly 7. As such, first component 145 is fixedly attached to base frame section 94, and second component 146 extends through first component 145 and is adapted to rest on a supporting surface, i.e., a kitchen floor. In a preferred form of the invention, arranged within lifting mechanism 140 is an electrically operated drive unit 160 operatively coupled to a worm screw 165. Upon activation of drive unit 160, first and second components 145 and 146 are caused to shift relative to each other. With a corresponding lift mechanism 140 being provided in base frame section 90 and frame sections 98, 103 and 106 being attached to base frame sections 90 and 94, activation of lifting mechanisms 140 will function to vertically adjust the height of the entire island assembly 7. In accordance with the preferred form of the invention, island assembly 7 is provided with an adjustable height range in the order of one foot (approximately 30 cm). Although each drive unit 160 is preferably constituted by an electric motor, other lifting arrangements could also be employed, including hydraulic and pneumatic systems.

Figure 5:
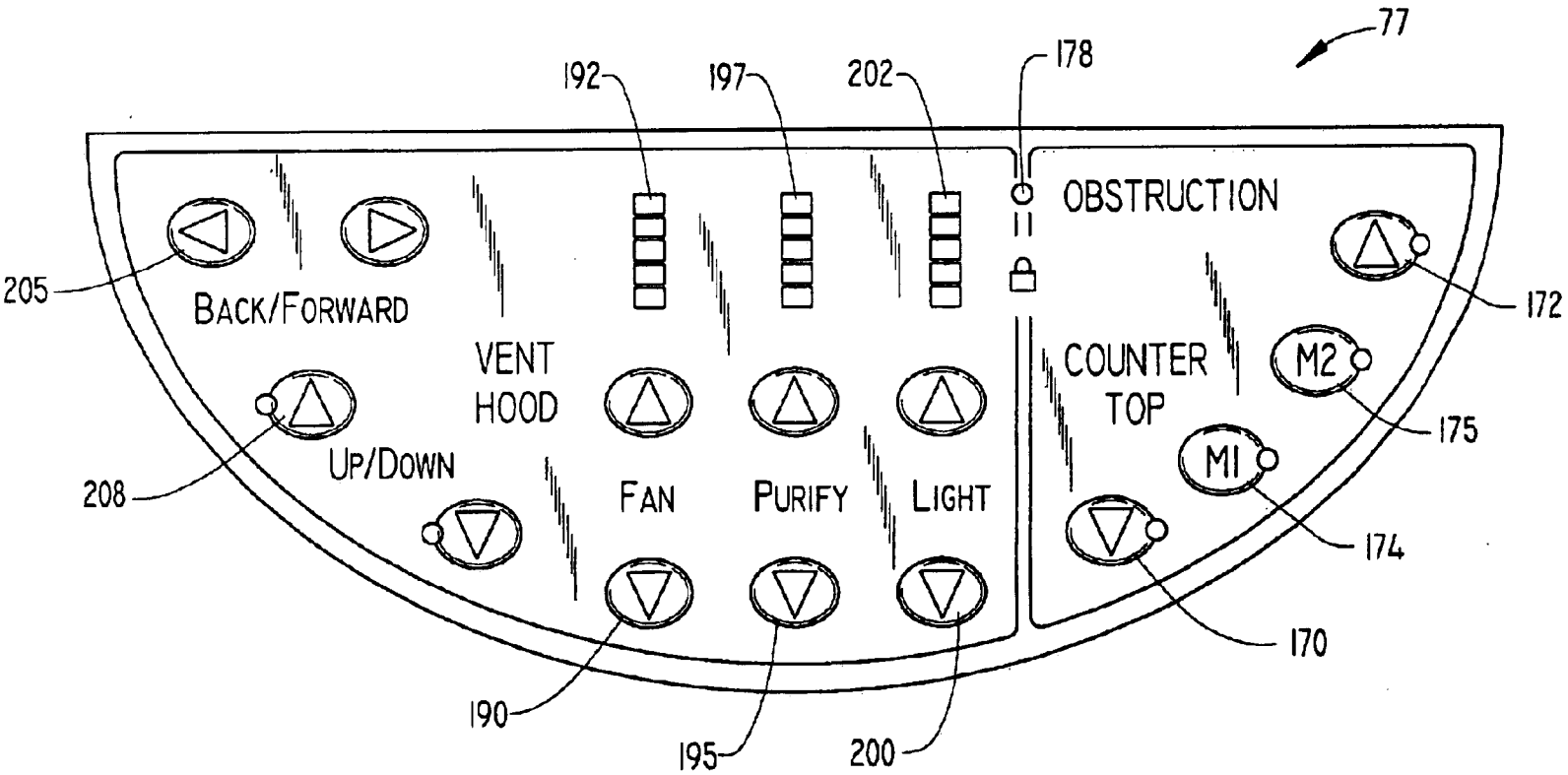
FIG. 5 is a top view of a control panel employed in connection with the kitchen island of FIG. 4.

In accordance with the most preferred form of the present invention, control unit 77 is constructed in the manner shown in FIG. 5. As shown, control unit 77 includes a plurality of control members adapted to operate various mechanisms associated with island assembly 7. Arranged on the right side of control unit 77 are control members 170 and 172 which preferably take the form of buttons and are used to control the vertical height adjustment of island assembly 7 through lifting mechanisms 140. Interposed between control members 170 and 172 are control members 174 and 175, each being adapted to store a programmed memory height for island assembly 7. Control members 174 and 175 are preferably preprogrammed for two intermediate height positions. However, a consumer can preferably reprogram these positions, such as by simply holding down the corresponding control member 174, 175 for a few seconds once the desired setting height is achieved through control members 170 and/or 172. Control unit 77 is preferably provided with at least one LED 178 to signal the sensing of any obstruction beneath island assembly 7 during a lowering sequence. Such a sensing arrangement can take various forms, including the monitoring of current spikes for drive units 160.

As shown, control unit 77 also includes control members 190 which are used to increase or decrease the operating speed of an exhaust fan (not shown) associated with hood 47. The fan speed is preferably indicated through an LED meter 192. Adjacent control members 190 are control members 195 which are used to raise or lower a fan speed for a room purifier (not separately shown). An LED meter 197 is also preferably provided as a visual indicator for the status of this function as well. Preferably, hood 47 includes one or more lighting units (not shown), the intensity of which can be regulated through control members 200 and reflected at LED meter 202.

As indicated above, hood 47 is adjustable both vertically and horizontally. In accordance with the most preferred form of the invention, hood 47 can be shifted to a position over the entire cooktop 45 or just a rear portion thereof. In addition, hood 47 can be lowered to a position substantially flush with countertop 50. For shifting hood 47 forward or backward, control unit 77 includes control members 205. For selectively raising and lowering hood 47, control members 208 are provided. Obviously, although not depicted, control members 205 and 208 are associated with respective drive systems, preferably utilizing electric motors, which act on support 48 to make the desired position adjustments.

Based on the above, it should be readily apparent that the modular kitchen system 2 of the invention represents an extremely versatile arrangement which will allow designer kitchen islands to be readily constructed from modular, interconnected sections, while employing multiple, distinct base units to accommodate vertical shifting of the entire island assembly. Based on available variations in section sizes, the consumer can custom design a kitchen island based on personal preferences and spatial requirements. In addition, with a given size for island assembly 7, variations can also be made. For instance, island assembly 7 can include a 42 inch (107 cm) cooktop 45 or a 30 inch (76 cm) cooktop in combination with a 15 inch (38 cm) storage section in the same overall span. Certain sections are preferably made so as to be readily interchangeable, such as by making dishwasher and mini-refrigerator modules the same dimensions, each of which is generically represented in the figures, such as by modular unit 40 in FIG. 2. This adds further versatility to the overall system.

Figure 6:
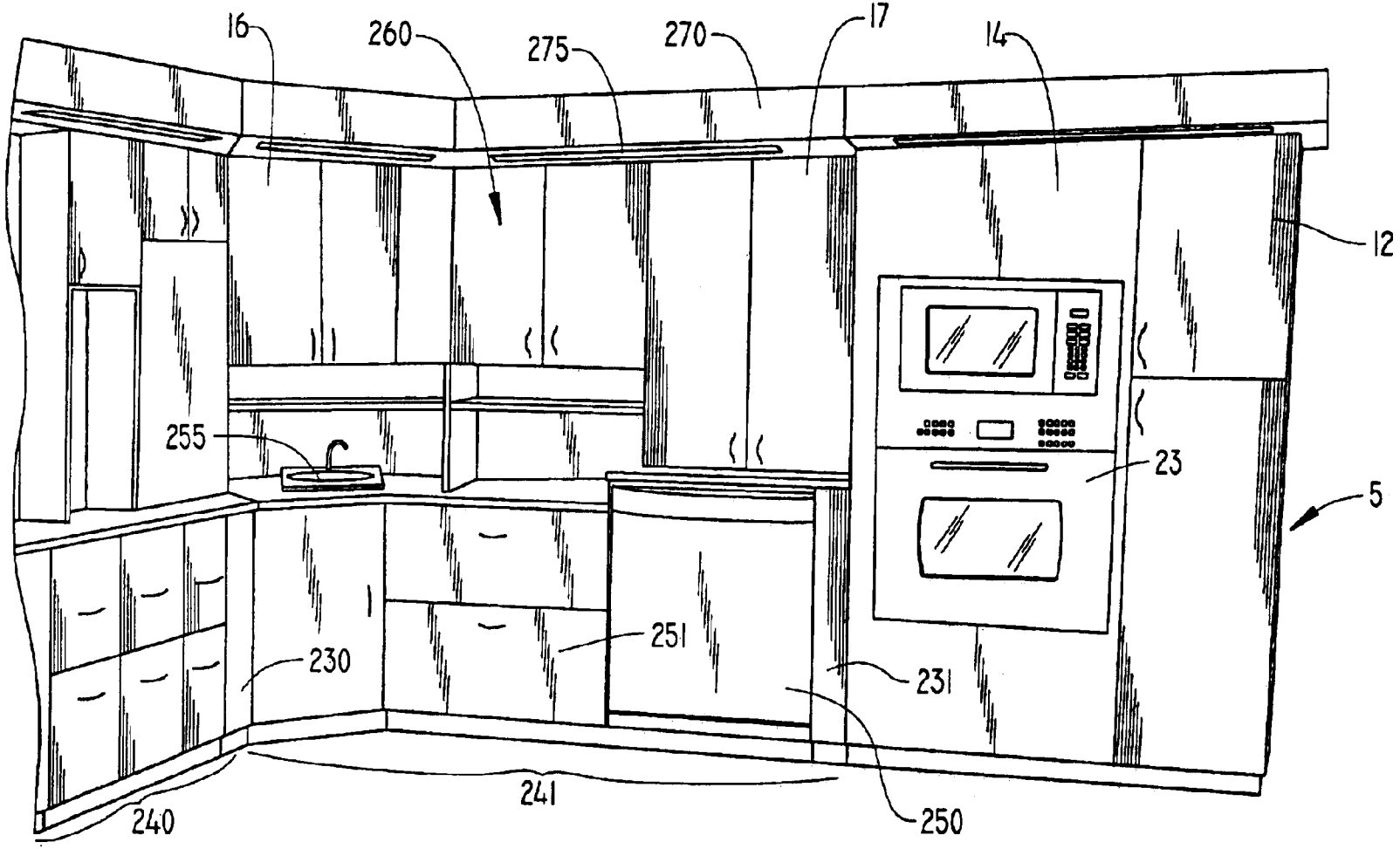
FIG. 6 is an enlarged perspective view of a portion of the wall assembly of FIG. 1.

In a manner analogous to the construction of island assembly 7, wall unit 5, as shown in FIGS. 1 and 6, is constructed from a select arrangement of fixed storage units 11 and 12, fixed appliance units 14 and 15, and modular appliance and/or storage units 16 and 17. In a preferred form of the invention, modular appliance and/or storage units 16 and 17 are interposed and interconnected with vertically adjustable base units 230, 231 and 232 (see FIG. 1) to form vertically adjustable wall sections 240, 241. As the particular arrangement of each wall section is left up to each consumer, the description will reference vertically adjustable section 241 as being a representative example of each section.

Vertically adjustable wall section 241 includes a first vertically adjustable base unit 231, and a second vertically adjustable base unit which is not shown as it is located at one rear side of appliance unit 16. In any event, interposed between these base units are appliance unit 17, which incorporates a dishwasher 250, storage unit 251, and appliance unit 16 having an associated sink 255. Mounted above and interconnected with modular units 16, 17, 231, and 251 are a plurality of additional storage units generally indicated at 260.

In a preferred form of the invention, wall section 241 is vertically adjustable, independently from any other section, based on the particular requirements of the consumer. Upon activation of a control unit (not shown), units 16, 17, 231, 232 and 251 of wall section 241 will be raised or lowered in unison with storage units 260 and soffit 270. Soffit 270 includes at least one light assembly 275 arranged therein such that the working surfaces can be illuminated. In this manner, as section 241 is adjusted, light 275 remains at a fixed distance relative to the working surface. Based on this overall construction, the consumer can adjust the work surface height of a particular wall section without affecting the working height of other sections or the amount of available light directed onto the working surface.

In a similar manner, wall section 240, from adjacent refrigerator 25 to adjacent appliance unit 16, can be raised or lowered independently and as an integrated piece. Therefore, it should be realized that wall sections 240 and 241 are formed in a manner directly analogous to that described above with respect to island assembly 7, while also being selectively, vertically shiftable through the use of modular base units to which interchangeable appliance and/or storage units are secured. In connection with each of the appliance units, it is preferable in accordance with the invention to employ individual wiring instead of hard-wiring the various units. This enhancing the ability to interchange various units as desired in a relative quick and easy manner, without the need of a skilled artisan.

Although described with reference to preferred embodiments of the invention, it should be readily understood that various changes and/or modifications can be made to the invention without departing from the spirit thereof. For instance, although the figures depict a specific arrangement of the kitchen system, it should be realized that the invention enables the construction of a wide variety of differently configured modular kitchen systems. In general, the invention is only intended to be limited by the scope of the following claims.

We claim:

1. A modular kitchen system comprising:

a modular appliance unit adapted to intergrate into a wall unit or a kitchen island unit, said modular appliance unit including an appliance frame section and a kitchen appliance selected from the group consisting of: a range, a dishwasher, a mini-refrigerator and a cooktop;

at least one storage unit arranged adjacent and attached to the appliance flame section;

a pair of modular base units, each of said base units including a base frame section, a lifting mechanism, and at least one vertically adjustable support operatively connected to the lifting mechanism, each base frame section being connected to a respective one of the appliance frame section and the at least one storage unit, with the pair of modular base units being arranged laterally outwardly of the modular appliance unit and the at least one storage unit; and a control unit operatively coupled to each of the lifting mechanisms, wherein activation of the control unit operates to vertically adjust a height of the modular appliance unit through the vertically adjustable supports.

2. The modular kitchen system according to claim 1, further comprising: an electrically operated drive unit operatively interconnecting the control unit and the lifting mechanism of each of said base units, wherein activation of the control unit operates the lifting mechanism through the electrically operated drive unit.

3. The modular kitchen system according to claim 1, wherein each of the at least one vertically adjustable supports includes first and second relatively shiftable components, with the first component being fixedly attached to a respective said base frame section and the second component being positioned on a supporting surface while being movably attached to the first component.

4. The modular kitchen system according to claim 3, wherein said lifting mechanism includes a worm screw mounted within the at least one vertically adjustable support, said worm screw interconnecting the first and second relatively shiftable components such that operation of the lifting mechanism causes the first and second shiftable components to shift relative to each other.

5. The modular kitchen system according to claim 1, further comprising: a plurality of sheathing panels mounted to the appliance frame and base frame sections, said sheathing panels serving as a finish covering of the modular kitchen system.

6. The modular kitchen system according to claim 1, wherein said control unit includes a plurality of stored height positions, said stored height positions constituting a plurality of user selected, predetermined height settings.

7. The modular kitchen system according to claim 1, wherein each of the appliance frame and base frame sections include a plurality of structural support members, each of said structural support members being formed with an aperture which receives a mechanical fastener for interconnecting the appliance frame section to a respective said base frame section.

8. A modular kitchen system comprising:

first and second modular base units each defining a base frame, at least one vertical adjustment mechanism, and a drive unit, said vertical adjustment mechanism including first and second relatively shiftable components, with the first component being attached to the base frame and the second component being adapted to be supported on a surface while being movably attached to the first component, said drive unit being interconnected to the first and second components for selectively, relatively shifting the first and second components to effect vertical shifting of a respective one of the first and second base units;

at least one replaceable, modular appliance unit including at least one kitchen appliance carried by an appliance frame, said kitchen appliance being selected from the group consisting of: a range, a dishwasher and a mini-refrigerator;

a modular storage unit arranged adjacent the appliance frame, said appliance frame and said modular storage unit being fixedly connected to each of the first and second base units to define an overall kitchen assembly which can be concurrently, vertically shifted through the first and second base units;

a kitchen countertop extending over the first and second base units, as well as the at least one replaceable, modular appliance unit and the modular storage unit; and a control unit operatively coupled to the drive unit of each of the first and second base units, wherein selective activation of the control unit operates to vertically adjust a height of the modular kitchen assembly.

9. The modular kitchen system according to claim 8, wherein each said drive unit includes a worm screw mounted within the at least one vertical adjustment mechanism, said worm screw interconnecting the first and second relatively shiftable components such that synchronized operation of the drive units for the first and second base units causes the kitchen assembly to vertically shift.

10. The modular kitchen system according to claim 8, further comprising a plurality of sheathing panels mounted to the appliance frame and base frame, said sheathing panels serving as a finish covering of the modular kitchen assembly.

11. The modular kitchen system according to claim 8, wherein said control unit includes a plurality of stored height positions, said stored height positions constituting a plurality of user selected, predetermined height settings.

12. The modular kitchen system according to claim 8, wherein each of the appliance frame and base frame sections include a plurality of structural support members, each of said structural support members being formed with an aperture which receives a mechanical fastener fix interconnecting the appliance frame section to a respective said base frame section.

13. The modular kitchen system according to claim 8, further comprising: at least one upper cabinet assembly mounted above the kitchen assembly, with said upper cabinet assembly being selectively, vertically repositioned in unison with the modular appliance unit.

14. A method of establishing a vertically adjustable kitchen system comprising:

selecting at least first and second modular units from a plurality of interchangeable modular units, with the first modular unit constituting a modular storage unit and the second modular unit constituting a modular appliance unit, with the modular appliance unit being selected from the group consisting of: a range, a dishwasher, a mini-refrigerator and a cooktop;

interconnecting the first and second modular units to establish a selected modular unit;

positioning the selected modular unit between a pair of modular, vertically adjustable base units, with each of the base units including first and second relatively shiftable components;

securing the selected modular unit between each of the first components of the base units thereby creating a modular assembly; and selectively activating a control such that at least the selected modular unit and each of the first components of the modular assembly are vertically repositioned to a selected level.

15. The method of claim 14, further comprising:

automatically shifting the modular kitchen system to a predetermined height position upon selecting a memory control element associated with the control.

16. The method of claim 14, further comprising:

mounting at least one upper cabinet assembly above the modular unit such that the upper cabinet assembly is vertically repositioned in unison with the modular unit.

17. The method of claim 16, further comprising:

arranging a countertop across the modular unit and the base units; and vertically repositioning the countertop in unison with the modular unit and the first component of each base unit.

18. The method of claim 17, further comprising:

attaching a table to the modular unit at a position offset from the countertop; and vertically repositioning the table in unison with the modular unit, the first component of each base unit, and the countertop.

* * * * *